US005230429A

United States Patent [19]

Etheredge, III

[11] Patent Number: 5,230,429

[45] Date of Patent: Jul. 27, 1993

[54] TAMPER-EVIDENT INJECTABLE DRUG VIAL

[76] Inventor: Robert W. Etheredge, III, 5 Oakhill Rd., Natick, Mass. 01760

[21] Appl. No.: 627,186

[22] Filed: Dec. 13, 1990

[51] Int. Cl.[5] ..... B65D 39/00

[52] U.S. Cl. ..... 206/459.1; 206/807; 215/249

[58] Field of Search ..... 206/807, 459; 215/230, 215/232, 247-251, 365, 366, DIG. 3

[56] References Cited

U.S. PATENT DOCUMENTS 2,629,379 2/1953 Fields ..... 215/247 X
4,418,827 12/1983 Butterfield ..... 215/366
4,429,803 2/1984 Butterfield ..... 215/366
4,546,881 10/1985 Tasma ..... 206/459
4,635,807 1/1987 Knapp ..... 215/247

*Primary Examiner*—Bryon P. Gehman
*Attorney, Agent, or Firm*—Alvin Isaacs

[57] ABSTRACT

A pharmaceutical vial containing a quantity of an injectable drug intended to be withdrawn by introducing a hypodermic needle through the vial neck, the vial being rendered tamper-evident by means of a stretched elastic member which will rupture when penetrated by a needle, to make visible the needle insertion within the vial.

20 Claims, 4 Drawing Sheets

TAMPER-EVIDENT INJECTABLE DRUG VIAL

BACKGROUND OF THE INVENTION

Incidences of drug abuse of controlled substances are of course in general so well documented and of such common knowledge that they need not be discussed further. However, what is not so well known and may be shocking to the uninitiated is the ever increasing drug abuse in hospitals and clinics involving the theft of injectable drugs. This theft is almost exclusively by staff members for their personal use to satisfy an addiction.

These injectable drugs are typically marketed in vials having a liquid-tight stopper through which a hypodermic needle may be introduced to withdraw a measured dosage from a larger quantity of liquid drug preparation contained within the vial. While these drug-containing vials are routinely kept under lock and key with only selected clinicians having authority to access the drug supply, it is nevertheless an ever increasing fact that the procedures intended to safeguard the accessibility to the drug closet are not sufficient to keep out the drug users who of course are highly motivated to support their habit.

When they do gain access, they will frequently attempt to hide the invasion of the drug supply by replenishing the stolen quantity with an aqueous solution. This compounds the seriousness of the matter since it in turn means that a patient requiring a given dosage, e.g. a narcotic to relieve pain, will in fact receive a diluted or attenuated dosage instead.

There is accordingly a great need in hospitals and clinics for tamperproof injectable pharmaceutical vials and, failing that, for tamperevident pharmaceutical vials which will provide non-reversible visible evidence of tampering by the introduction of a needle to withdraw a dosage from within.

BRIEF DESCRIPTION OF THE INVENTION

In accordance with this invention, this task is solved in an elegant manner by covering one surface of the vial stopper with a stretched or elongated elastic element which will rupture or break when pierced by the needle so as to reveal the surface of the stopper previously covered by the elastic element. When the stopper surface so revealed is of a distinctive color or contains a design or logo, the tampering by introducing the needle will be readily apparent to the eye.

DETAILED DESCRIPTION OF THE INVENTION

As previously stated, the task of the present invention is directed to providing a tamper-evident system which will visibly indicate when an injectable quantity of a drug has been withdrawn from a pharmaceutical vial.

In accordance with this invention, the task is solved in an elegant manner by stretching an elastic element across one surface of the vial stopper which is inserted in the mouth of the vial to provide a liquid-tight closure for the vial as well as to prevent ingress of any contaminants. When a hypodermic needle is introduced through the stopper in routine fashion to remove a quantity of the vial contents, the stretched elastic element ruptures to reveal the superposed stopper surface previously covered by the elastic member. When this stopper surface is of a markedly different color or pattern from the elastic member, the penetration of the needle will be readily apparent to the eye.

The invention will be more readily understood by reference to the accompanying illustrative drawings taken in conjunction with the following detailed description.

Figure 1:
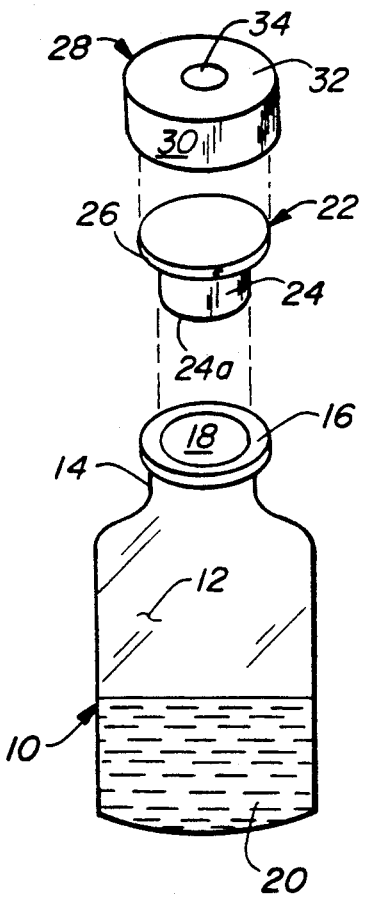
FIG. 1 is an exploded perspective view of a conventional pharmaceutical vial of the prior art as contemplated by this invention.

FIG. 1 illustrates a conventional prior art pharmaceutical vial of the type to which the present invention is directed. As shown therein, vial 10 comprises a typically transparent plastic or glass container 12 having a neck 14 terminating in a lip 16 defining an opening 18 at the container mouth for receiving a quantity of liquid 20 comprising a drug intended for injection into the vein of a patient. Illustrative drugs will include narcotics and other controlled substances such as morphine, Demerol, opium, belladonna, Valium, and the like intended for injection in moderate doses for such therapeutic purposes as to allay sensibility, relieve pain, produce profound sleep, provide mood changes, etc. After the liquid drug preparation 20 has been introduced into container 12, a rigid or semi-rigid plastic or rubber stopper 22 is inserted into opening 18 to provide a fluid-tight closure as well as to prevent ingress of contaminants. As shown, stopper 22 has a base portion 24 terminating in a bottom or lower surface 24*a* which is seated within opening 18 in the neck portion 14 of container 12 with a top or upper flange portion 26 seated on lip 16. Preferably, the periphery of flange 26 is substantially identical in size and shape to that of lip 16 so that when the stopper 22 is seated within the container, the flange 26 is predominantly coincident with the lip 16 of the container. When seated within the container, it will of course be appreciated that the base portion 24 is of a dimension such that it tightly engages the inside of neck of the container so as to provide the desired seal. The containers for pharmaceutical vials come in a whole variety of shapes and it will of course be appreciated that the particular configuration for container 12 will be a matter of individual choice or whim and per se comprises no part of this invention. In like manner, the stoppers 22 are available in various sizes and shapes. The base portion 22 may be of uniform diameter or it may be truncated. Again, the selection will be a matter of choice and per se comprises no part of this invention.

After stopper 22 is seated within the container, a flexible cap 28 of a metal such as aluminum or other impermeable material is crimped over flange 26 and lip 16. As shown, cap 28 has an upstanding base portion 30 and a generally planar top member 32 provided with a generally central area 34, the periphery of which is scored or fractured so as to be removable for introducing a hypodermic needle without removal of the cap.

Figure 2:
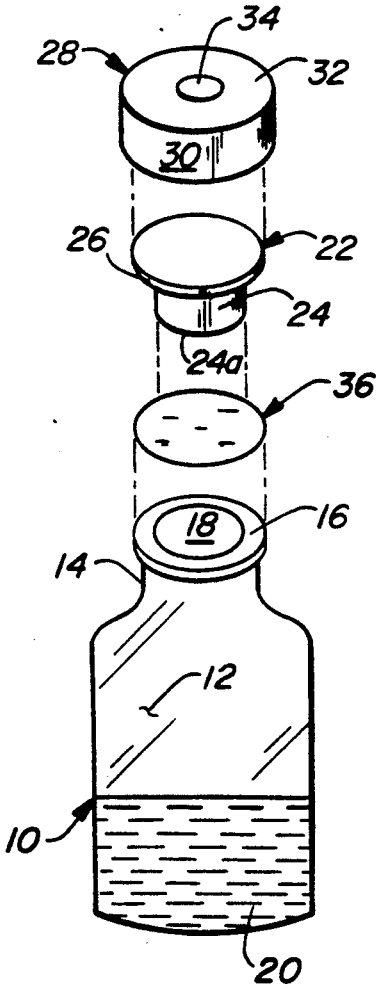
FIG. 2 is a similar view of a pharmaceutical vial illustrating one embodiment of this invention.

FIG. 2 illustrates a simplified and less preferred embodiment of this invention. As shown, an elastic element 36 comprising a suitable elastomeric material is provided. Suitable elastomers include the known natural, butyl or synthetic rubbers, e.g. polyurethane, poly(-dimethylsiloxane), thermoplastic elastomers, etc. Elastic element 36 is maintained in a stretched position by hand or by suitable mechanical means and stopper 22 is then inserted, whereby the elastic member extends across the underside 24*a* of the stopper, around its periphery and outside of the container where it is frictionally locked against the outside of lip 16 in its elongated or stretched state.

Elastic element 36 will preferably be opaque so as to hide from view the underside 26*a* of the stopper. It may for example be of a light color which may be regarded as undramatic so as to heighten the effect when it bursts. In order to prevent replacement by another elastic element and thereby further insure the tamper-evident feature of this invention, it may contain indicia in the form of a logo, design, or wording such as "SAFE" or "USE". In any event, surface 24*a* will preferably be of a distinctive color or design so as to be readily apparent to the eye when exposed to view.

When portion 34 is removed for use and a needle inserted through the underlying stopper so as to penetrate within the container for removal of a portion of its contents, elastic element 36 will burst, revealing the bottom surface 24*a* of the stopper and thereby reveal the introduction of the needle.

Figure 2A:
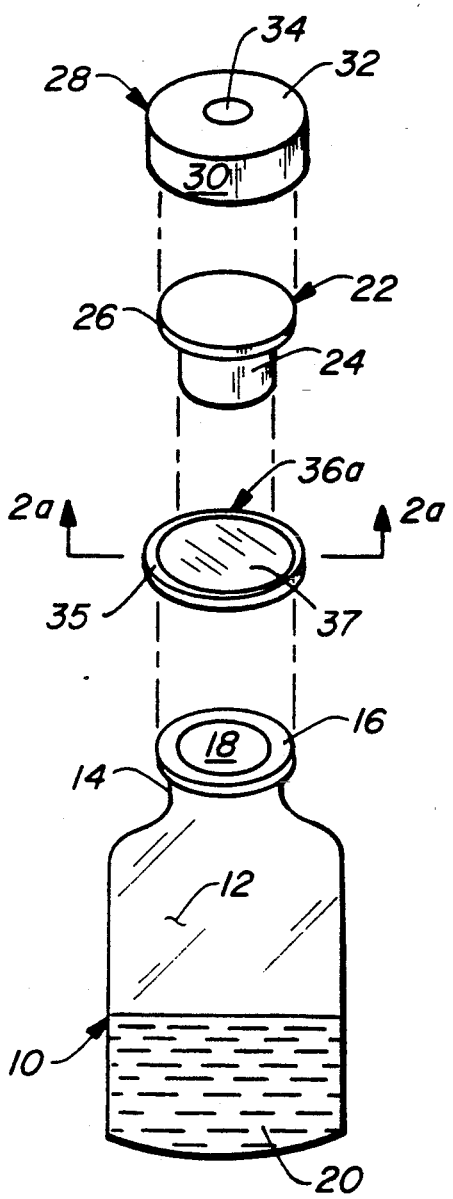
FIG. 2*a* is a similar view illustrating an alternate embodiment of this invention.
Figure 2B:
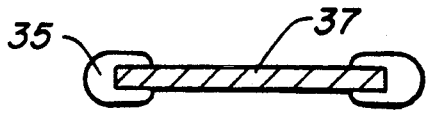
FIG. 2*b* is a sectional view taken along lines 2*a*—2*a;*

A preferred embodiment for providing a tamper-evident elastic element beneath the stopper is shown in FIGS. 2*a* and 2*b*. As shown therein, elastic element 36*a* is provided comprising an annular recessed frame member 35 in which an elastomeric member 37 is secured, e.g. by crimping frame member 35 so that it tightly engages both sides of elastomeric member 37 or by crimping in combination with suitable adhesive means or heat sealing.

Elastic element 36*a* has an outer diameter substantially the same as that of lip 16 so that they are predominantly coincident when superposed. The inner diameter of the frame 35 is slightly greater than the outer diameter of stopper 22 so that the stopper may be inserted therethrough and then within the container 12. When the stopper is so inserted, the elastomeric member 37 is caused to be stretched across the underside 24*a* of the stopper, as described above in the description of FIG. 2. As alluded to above, the embodiment of FIG. 2*a* is considered to be preferred to the embodiment of FIG. 2. While they will be essentially identical in function, the embodiment of 2*a* is preferred only because it is believed it may be more feasible to manufacture.

Figure 3:
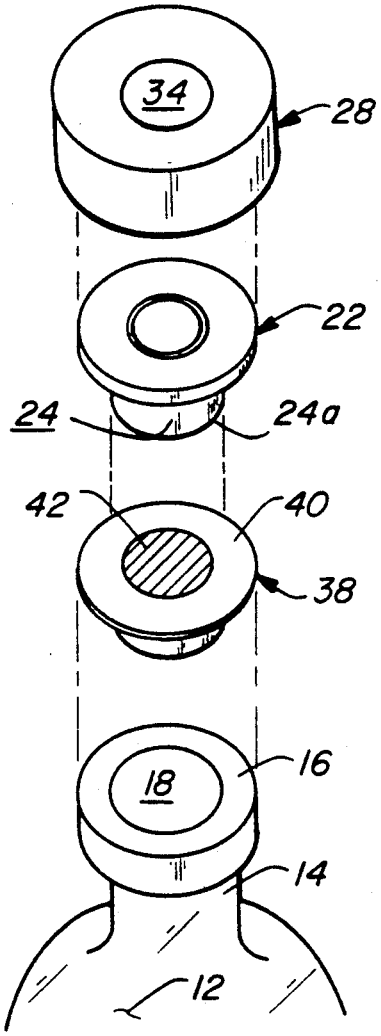
FIG. 3 is an exploded perspective view of a pharmaceutical vial illustrating another embodiment of this invention.
Figure 4:
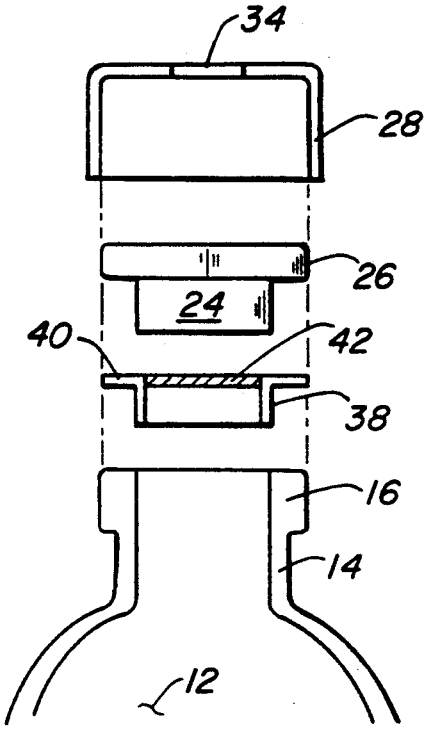
FIG. 4 is an exploded sectional view of the vial of FIG. 3.
Figure 5:
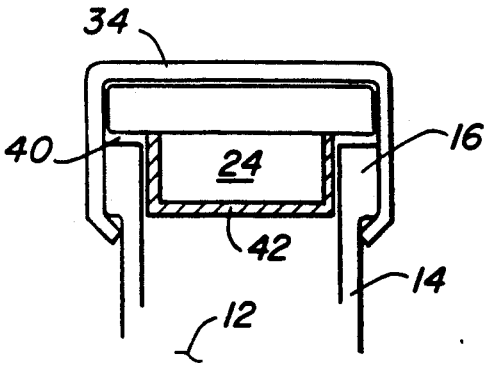
FIG. 5 is a fragmented sectional view of the assembled vial of FIGS. 3 and 4.
Figure 6:
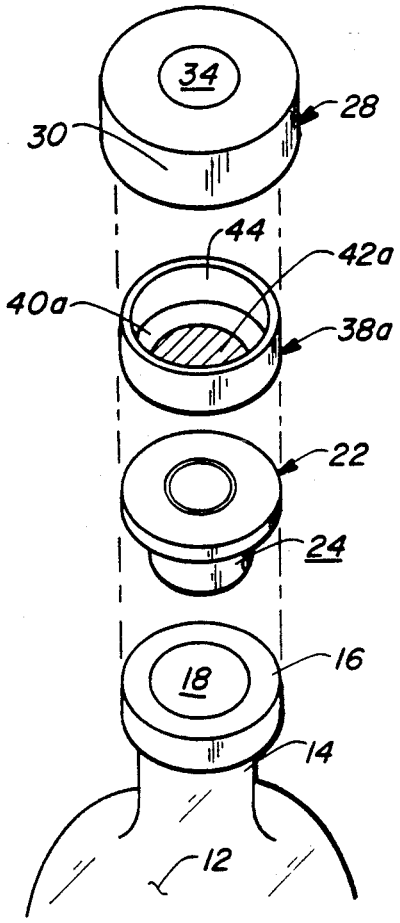
FIG. 6 is an exploded perspective view of yet another embodiment of this invention.
Figure 7:
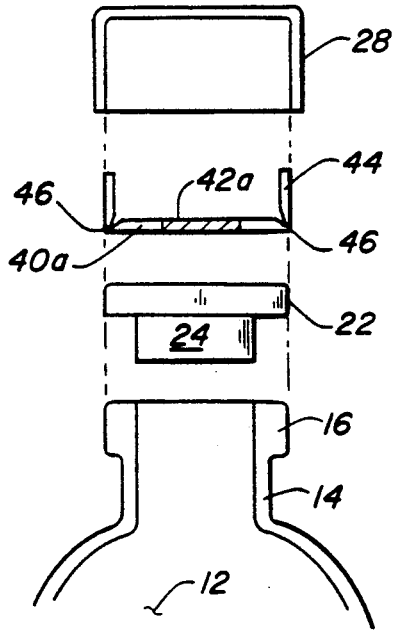
FIG. 7 is an exploded sectional view of the vial of FIG. 6.

Another embodiment of the invention is illustrated in FIGS. 3–5. As shown therein, elastic element 38 comprises an annular frame 40 which, like elastic element 36*a* in FIG. 2*a* contains an elastomeric member 42 in its relaxed or unstretched condition. However, while elastic element 36*a* is substantially flat or planar, elastic element 38 has an upstanding base or bottom member 43 extending slightly less depthwise into the neck 14 of container 12 than does the base portion 24 of stopper 22. As with the embodiment of FIG. 2*a*, the annular frame 40 has an outer diameter substantially the same as that of lip 16 so that when the elastic element 38 is positioned within the container, the annular frame 40 is predominantly coincident with lip 16. It will of course be understood that the inner diameter of the frame 40 is slightly larger than the outer diameter of base 24 of stopper 22. Accordingly stopper 22 may be inserted through the frame 40 of element 24 and then into the neck of the container. When so positioned, as best seen in FIG. 5, elastomeric member 42 is stretched around the side and over the bottom surface of the stopper. As in the other embodiments, when penetrated by a needle, the elastomeric member 42 will rupture, revealing the underside of the stopper.

In the foregoing illustrative embodiments, the tamper-evident elastic element is disposed within the pharmaceutical vial beneath the vial stopper. In these embodiments, tampering is revealed by viewing the underside of the stopper, e.g. by inverting the vial so that the stopper may be viewed from within.

It is also within the scope of the invention to provide the elastic element covering the outer surface of the stopper. While this may be accomplished simply by stretching an elastic member by hand or by mechanical means over the top of the stopper (analogous to the embodiment of FIG. 2) and then securing it in its stretched condition by tightly crimping the cap thereover and/or by heat-sealing around the lip and neck of the container, a preferred method of doing so is illustrated in FIGS. 6–9.

As shown therein, the elastic element 38*a* comprises an annular frame 40*a* in which is secured, preferably in its relaxed condition, elastomeric member 42*a*. Frame 40*a* containing the relaxed elastomeric member 42*a* is hinged to upstanding member 44 by means of hinges 46.

Figure 8:
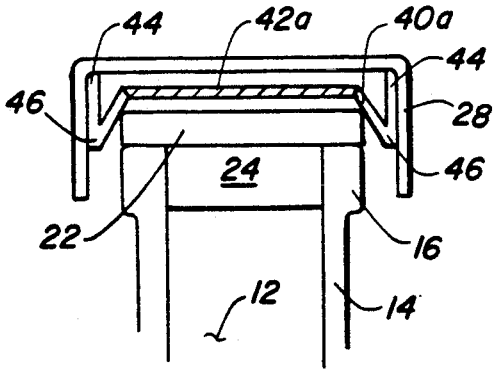
FIG. 8 is a fragmented sectional view showing the vial of FIGS. 7 and 8 in a partially closed and assembled position.
Figure 9:
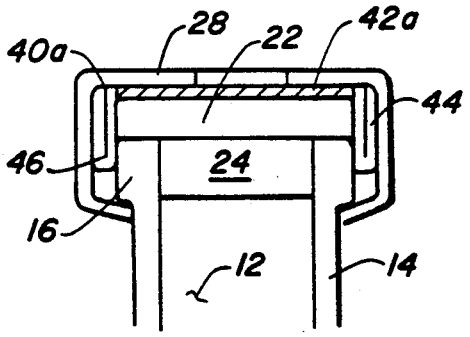
FIG. 9 is a similar view showing the vial of FIGS. 7 and 8 fully assembled.

In this embodiment, stopper 22 is first inserted within container 12 with its upper flange 26 seated on lip 16, as best seen in FIGS. 8 and 9. Thereafter, elastic element 38*a*, whose outer diameter is slightly less than the inner diameter of cap 28, is seated on flange 26 of stopper 22. When cap 28 is thereafter pressed downward over element 38*a* and the top of cap 22 for crimping over the stopper 22 and lid 16, the downward pressure exerted on upstanding member 44 by the top 32 of the cap causes the hinges 46 to pronate, as seen in FIG. 8. This pronation of hinges 46 in turn causes upward movement of the elastomeric member towards top 32 of cap 28, as seen in FIG. 8. As the elastomeric member moves upward towards the cap 28, it becomes stretched. When the cap is fully seated over element 38*a* and stopper 22 and crimped to fully assemble the pharmaceutical vial (FIG. 9), the elastomeric member in its fully stretched state then extends across the top of the pharmaceutical vial tightly sandwiched between the inner surface of the top 32 of the cap and the outer surface of the top 26 of the stopper.

In this embodiment, as distinguished from the embodiments previously described, tampering will be evidenced by viewing the vial from the top through the opening in the cap provided by removal of center portion 34 of the cap for insertion of the needle.

From the foregoing description, it will thus be seen that the present invention is capable of many modifications and variations to provide a tamper-evident pharmaceutical vial containing a controlled substance for injection. The size and shape of the vial and the stopper for use therein are not critical. Any of the multiplicity of sizes and shapes currently commercially available are contemplated.

The essence of the invention, stated simply, is providing a stretched elastic member over either the top or bottom surface of the stopper, which member will burst when penetrated even by a hypodermic needle to reveal the underlying stopper surface. When this surface has a color and/or is provided with a pattern distinctive from that of the elastomeric member, the needle penetration will be readily apparent to the eye.

Various means for providing the stretched elastomeric member are shown in the illustrative drawings. However, it is to be expressly understood that the invention is not limited thereto.

By way of illustration, the elastic element of FIGS. 2, 2*a* and 3 may be provided secured during manufacture to stopper 22 in its stretched condition. This may be accomplished, for example, by heat-sealing the elastomeric member over the bottom 24*a* and around the periphery of base member 24 while under tension to stretch the elastomeric member. In like manner, stopper 22 and elastic element 38*a* of FIGS. 6–9 may be manufactured as a unitary element wherein the bottom of the elastic element is sealed to the top 26 of the stopper. Alternatively, elastic element 38*a* may releasably engage the interior of cap 28, e.g. by spot welding or by means of a pressure-sensitive adhesive so that the respective components may be handled together during assembly and/or all three of the above components may be initially secured together to facilitate assembly of the pharmaceutical vial. Additionally, if desired the elastic element 38 (FIGS. 3–5) may be made of a single elastic material which is thicker in the region corresponding to frame 40, and then thins down to provide a rupturable member 42 spanning the neck of the vial. In like manner, elastic element 38*a* (FIGS. 6–9) may be constructed as a unitary element.

The elastomeric member and underlying stopper surface may be of any desired colors, provided, of course, that the selected colors will be distinctive from one another. Preferably, the respective colors should contrast markedly so as to enhance the visual effect when the stopper is revealed.

In the preferred embodiments, the rupturable elastic member will be opaque to mask the underlining stopper surface which will then be revealed to indicate the fact that a needle had previously penetrated the stopper. Most preferably, the elastic member will be of a relatively innocuous color and the underlying stopper surface a more brilliant color in order to indicate more dramatically the needle penetration. However, it will of course be appreciated that it is within the scope of this invention to provide a more brilliantly colored elastic member and a contrasting underlying stopper surface. Moreover, as alluded to previously, the elastic member may contain a pattern, logo, or indicia. This may, in some instances, be desirable in order to make it more difficult for the felon user to replace the ruptured elastic with another to conceal the tampering. To do so, assuming he first had the time and mechanical talent to attempt replacement, he would also need to have access to a supply of the distinctively personalized elastics. Where the elastic member contains a distinctive pattern, it will of course not be critical what color or colors it contains. Moreover, the background areas or, alternatively, the pattern areas may be transparent rather than opaque. Further, the covered surface of the stopper may have a distinctive pattern or logo and/or be provided with phrasing such as "DO NOT USE" which when visible would caution one of the tampering.

In essence, the only criticality with respect to the coloring of the elastic member and underlying stopper surface is that they be visually different or contrasting so that, upon rupturing of the elastic member, the penetration by a needle is visually apparent.

Since various changes may be made without departing from the spirit and scope of the invention herein contemplated, it is intended that all matter contained in the foregoing description and accompanying drawings shall be interpreted as being illustrative and not in a limiting sense.

What is claimed is:

1. A tamper-evident pharmaceutical vial comprising:

a container having a lip at one end defining an opening for inserting within the container a quantity of an injectable drug in liquid form, the drug being adapted for withdrawal by introducing a syringe through the opening;

a quantity of injectable drug within the container;

a stopper disposed within the lip for providing a liquid-tight closure for the vial, the stopper having a base portion terminating in opposed top and bottom end sections, the bottom end section of the stopper extending down into the container; and an elastic element stretched across one of the end sections, the elastic element being adapted to rupture when penetrated by a hypodermic needle introduced within the container for withdrawal of a dosage of drug from the quantity of drug contained therein, the elastic element being opaque or visually contrasting with the end section across which it is stretched, whereby the introduction of a needle within the container causes the elastic element to burst, thereby revealing to the eye the end section concealed by the elastic element prior to rupturing, and thereby providing visible evidence of tampering by introducing a needle.

2. A tamper-evident vial as defined in claim 1 wherein the elastic element and the end section concealed thereby are of distinctly different colors, whereby to enhance visual detection of tampering when the bottom end section is revealed upon rupturing of the elastic element.

3. A pharmaceutical vial as defined in claim 2 wherein the quantity of drug within the container is intended to provide more than one dosage for administration to a patient.

4. A pharmaceutical vial as defined in claim 3 wherein at least one of the elestic element and the end section of the stopper covered thereby contains a pattern, logo or indicia.

5. A tamper-evident vial as defined in claim 3 wherein the elastic element is stretched across the bottom end section of the stopper.

6. A pharmaceutical vial as defined in claim 3 wherein the top end section of the stopper is seated on the container lip.

7. A pharmaceutical vial as defined in claim 6 wherein the elastic element is positioned over the stopper.

8. A pharmaceutical vial as defined in claim 1 wherein the elastic element comprises an annular frame defining an opening of slightly larger inner diameter than the outer diameter of that portion of the stopper to be inserted within the container, an elastomeric member being secured within the annular frame and covering the frame opening, the stopper extending through the frame opening whereby to stretch the elastomeric member around the periphery of the base portion and across the bottom end section thereof.

9. A pharmaceutical vial as defined in claim 8 wherein the annular frame is seated on the lip of the container.

10. A pharmaceutical vial as defined in claim 9 wherein the annular frame and the container lip are of substantially the same diameter, whereby the lip and frame seated thereon are predominantly coincident.

11. A pharmaceutical vial as defined in claim 8 wherein the frame is substantially planar in configuration.

12. A pharmaceutical vial as defined in claim 8 wherein the frame extends depthwise within the container.

13. A pharmaceutical vial as defined in claim 12 wherein the frame extends depthwise within the container to a lesser distance than does the stopper when seated within the container.

14. In a pharmaceutical vial comprising:

a transparent container having a neck portion terminating in a lip defining an opening into the container;

a quantity of a liquid drug dosage within the container, the drug dosage being intended to be withdrawn with a syringe to provide a plurality of injections into a patient;

a stopper disposed within the container for providing a liquid-tight closure for the vial, the stopper having a base portion terminating in opposed top and bottom end sections, the bottom end section of the stopper down within the neck portion of the container; and a flexible liquid-impermeable cap covering the stopper and being crimped over the lip of the container , the cap having a central area adapted to be removed to insert a needle within container for withdrawal of a quantity of the drug dosage contained therein;

the improvement wherein an elastomeric element is stretched across the bottom end section of the stopper, the elastomeric element being adapted to rupture when penetrated by a hypodermic needle whereby to reveal to the eye the bottom end section of the stopper, the bottom end section and the elastomeric element possessing distinctly different visual appearances whereby to provide readily apparent visual evidence of any tampering by introducing a needle to penetrate the elastomeric element.

15. A pharmaceutical vial as defined in claim 14 wherein the elastic element comprises an annular frame defining an opening of slightly larger inner diameter than the outer diameter of the stopper, an elastomeric member being secured within the annular frame and covering the frame opening, the stopper extending through the frame opening whereby to stretch the elastic element around the periphery of the base portion and across the bottom end section thereof.

16. A pharmaceutical vial as defined in claim 15 wherein the annular frame is seated on the lip of the container, the frame being covered by the cap crimped over the lip of the container.

17. A pharmaceutical vial as defined in claim 16 wherein the annular frame and the container lip are of substantially the same size and shape, whereby the lip and frame seated thereon are predominantly coincident.

18. A pharmaceutical vial as defined in claim 16 wherein the frame is substantially planar in configuration.

19. A pharmaceutical vial as defined in claim 16 wherein the frame extends depthwise within the container.

20. In a pharmaceutical vial comprising:

a transparent container having a neck portion terminating in a lip defining an opening in the container;

a quality of liquid drug for providing a plurality of drug dosages within the container, each drug dosage being intended to be withdrawn with a syringe needle to provide a plurality of injections of the liquid drug into a patient;

a stopper for providing a liquid-tight closure for the container, the stopper having a base portion terminating in top and bottom end sections, the bottom end section of the stopper extending down within the neck portion of the container; and a flexible liquid-impermeable cap covering the stopper and being crimped over the lip of the container, the cap having a central area adapted for removal for insertion of the syringe needle through the underlying stopper for withdrawal of a drug dosage from the quantity of the liquid drug within the container;

the improvement wherein an elastic element is positioned between the cap and the top end section of the stopper, the elastic element extending across the top end section of the stopper, the elastic element being adapted to rupture when penetrated by the syringe needle whereby to reveal to the eye the top end section of the stopper as viewed through the central area where the cap is removed, the top end section and the elastic element possessing distinctly different visual appearances whereby to provide readily apparent visual evidence when a needle has been introduced to withdraw any liquid drug.

* * * * *